United States Patent [19]

Wolpert, Jr.

[11] Patent Number: 4,685,726

[45] Date of Patent: Aug. 11, 1987

[54] MODIFIED GERIATRIC CHAIR

[75] Inventor: George H. Wolpert, Jr., Columbia, Pa.

[73] Assignee: McKesson Corporation, San Francisco, Calif.

[21] Appl. No.: 584,643

[22] Filed: Feb. 29, 1984

[51] Int. Cl.[4] ..... A47C 7/02

[52] U.S. Cl. ..... 297/150; 297/155; 297/162

[58] Field of Search ..... 297/155, 154, 148, 149, 297/150, 135, 162, 160, 161

[56] References Cited

U.S. PATENT DOCUMENTS

| | | | |
|---|---|---|---|
| 1,217,231 | 2/1917 | Soper | 297/150 |
| 1,256,209 | 2/1918 | Darlaston | 297/154 |
| 3,467,432 | 9/1969 | Sullivan | 297/150 |
| 3,575,466 | 4/1971 | Thomas | 297/155 |
| 3,675,968 | 7/1972 | Douglas | 297/154 |
| 3,860,285 | 1/1975 | Hartman | 297/150 |

FOREIGN PATENT DOCUMENTS

| | | | |
|---|---|---|---|
| 12376 | of 1908 | United Kingdom | 297/155 |

*Primary Examiner*—James T. McCall
*Assistant Examiner*—Mark W. Binder
*Attorney, Agent, or Firm*—Dilworth, Paxson, Kalish & Kauffman

[57] ABSTRACT

A rotating and sliding tray is affixed to an arm of a geriatric chair to afford a service tray for the occupant that is neatly and securely stored at the side of the chair. The tray is slidably mounted on a movable and rotating holster so that vertical, longitudinal and rotational movement are all accomplished to place the tray in front of the occupant.

8 Claims, 8 Drawing Figures

MODIFIED GERIATRIC CHAIR

BACKGROUND OF THE INVENTION

1. Field of the Invention

The present invention relates to adjustable tray tables for chairs, and, more particularly, adjustable tray tables for geriatric, or geri chairs, or the like. In particular, the present invention allows the tray table on a chair, such as a geri chair, to be moved from its storage position into its service position when the geri chair is parked in very close quarters, either alongside a wall or in between other geri chairs.

2. Background of the Prior Art

As geri chairs become more and more common around hospitals and convalescent homes, it is many times necessary to arrange a number of chairs within narrow confines when meal time approaches. When the meal is served, it is necessary to arrange a tray in front of the geri chair occupant to support whatever food will be served. Many times it is very awkward, when using current geri chair/tray combinations, to move the tray from its storage position to its service position when there is not a large space around the chair.

SUMMARY OF THE INVENTION

The Modified Geriatric Chair is a hospital geriatric chair with a rotating and sliding tray affixed to one side of the chair arms. Two anchor brackets project outwardly and laterally from the arm rest. The outer ends of the brackets hold a stationary side tube in a parallel, spaced-apart relation to the arm. A slider tube rides inside the stationary tube and has its front end fixed to the front end of a tray holster. The rear end of the tray holster, is fixed to a slider cuff that rides end of the tray holster which is fixed to a slider cuff that rides side of the side tube. The forward-backward movement of the slider cuff is limited by the two brackets.

The front and rear ends of the tray holster are connected by a flat band so that the band is in parallel, spaced-apart relation to the slider tube. The band carries two parallel guide bushings and the bushings allow sliding movement of, in a transverse direction, two guide rods. The guide rods are fixed in a spaced-apart relation, to the underside of the tray.

Two brackets project laterally from the front and rear ends of the opposite arm rest and carry a guide rail in a spaced-apart parallel relation to the arm rest. The tray has a curved bracket running under the upward-side for sliding under the guide rail.

The tray is stored, in a stationary, vertical position at the side of the geri chair. Initially, the tray is raised straight up by grasping the curved bracket and lifting up (see FIG. 1). Then, the tray is moved forward as the slider tube moves inside the side tube (see FIG. 2). The tray is then rotated 90 degrees (FIG. 3) and rested on the guide rail and, then, moved back toward the occupant as much as desired (FIG. 4).

Accordingly, it is an object of the present invention to provide a modified chair tray that moves easily from its storage position to its service position.

It is a further object of the invention to provide a modified chair tray that moves easily from its storage position to its service position when the chair is in extremely tight quarters, either against a wall or next to other chairs.

It is a still further object of the invention to provide a modified chair tray that moves easily, even when in extremely close quarters, and is sturdy and dependable for use.

These and other objects and many attendant advantages of the present invention will be readily appreciated as the same becomes better understood by reference to the following detailed description when considered in connection with the accompanying drawings.

DESCRIPTION OF THE PREFERRED EMBODIMENT

Figure 1:
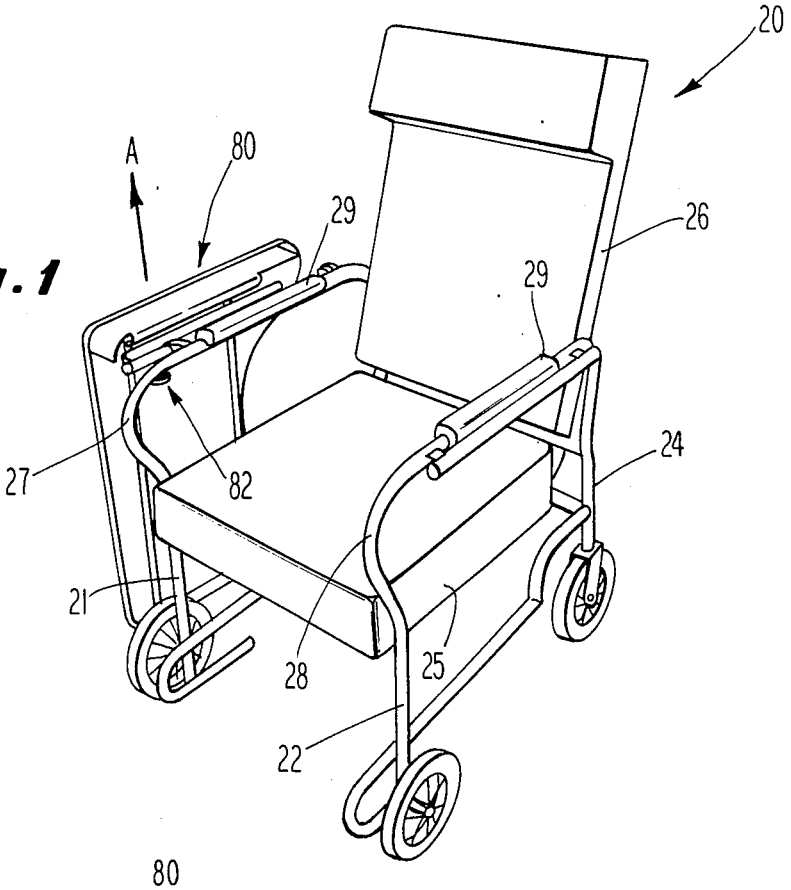
FIG. 1 is perspective view of the modified geriatric chair tray affixed to a geri chair with an arrow indicating vertical movement of said tray.

FIG. 1 shows generally a chair 20 with the modified tray 80 of the present invention attached thereto.

Figure 2:
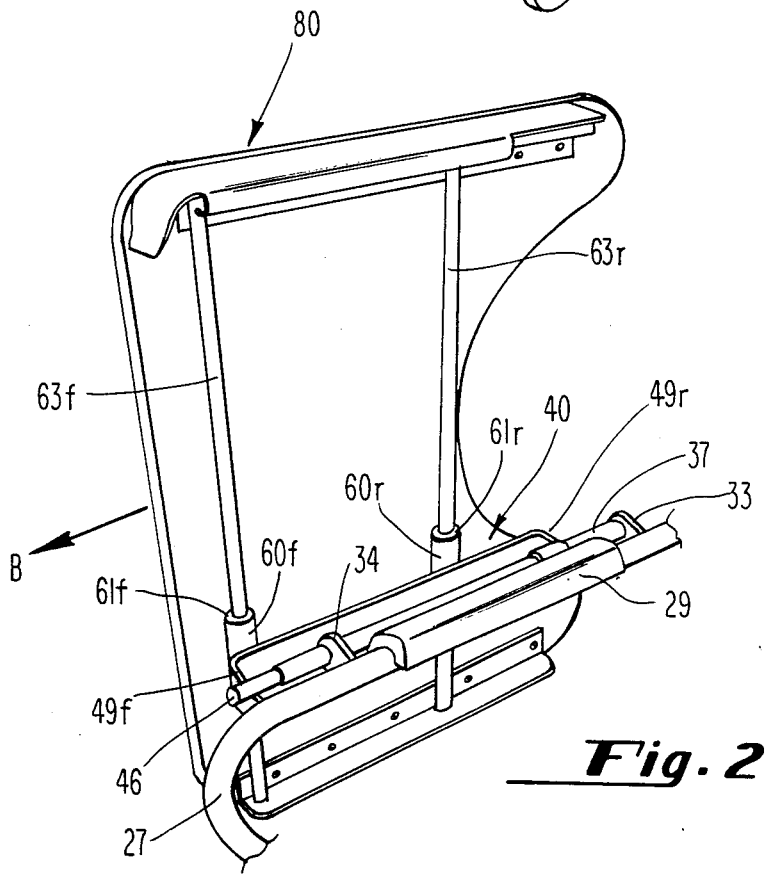
FIG. 2 is an enlarged fragmentary perspective view of the modified geri chair tray after the vertical movement of said tray with an arrow indicating forward movement of said tray.
Figure 3:
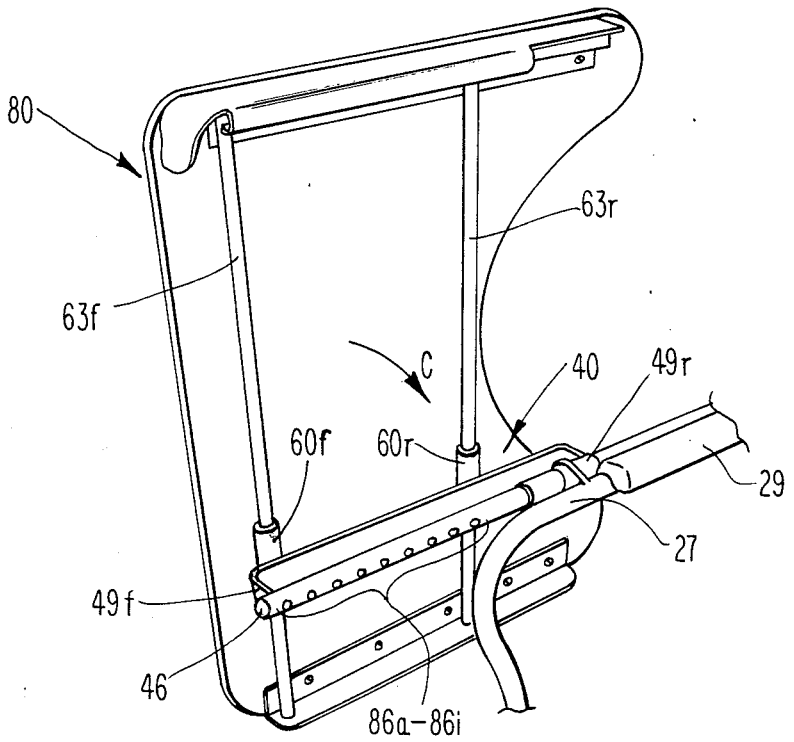
FIG. 3 is a fragmentary perspective view of the tray in the forward vertical position with an arrow indicating rotational movement to the horizontal initial position.
Figure 4:
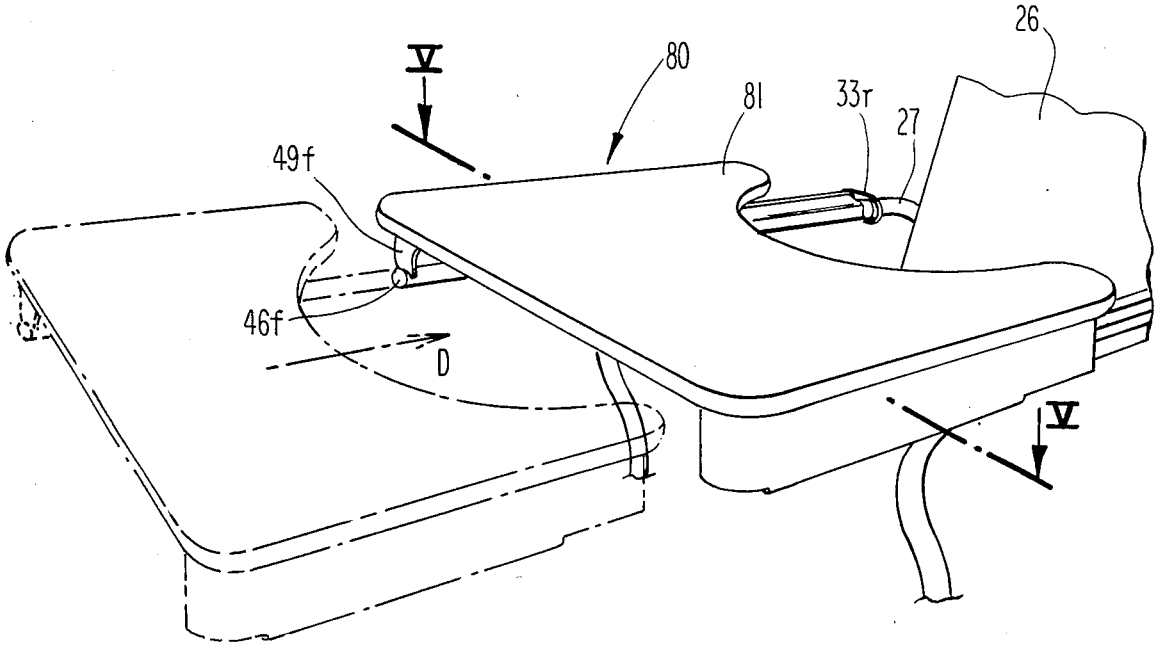
FIG. 4 is a fragmentary perspective view of the tray in its horizontal resting position with a phantom outline and arrow indicating previous position and movement, respectively.

FIGS. 2, 3 and 4 depict the movement of tray 80 and will be described below. Chair 20 is made from cold drawn steel tubular framing, or other suitable material as is known in the industry, and has front legs 21, 22 and rear legs 23 (not shown), 24 attached to the bottom of seat 25 and back portion 26 with arm rests 27, 28 projecting horizontally and then vertically to join with seat 25.

Although the drawings show tray 80 attached to the right side (as the patient is seated therein) of chair 20, it is to be understood that tray 80 may also be attached to chair 20 from the left side thereof. In that instance, the following description as to where on chair 20 items are attached and how they move thereon would be modified accordingly.

Figure 5:
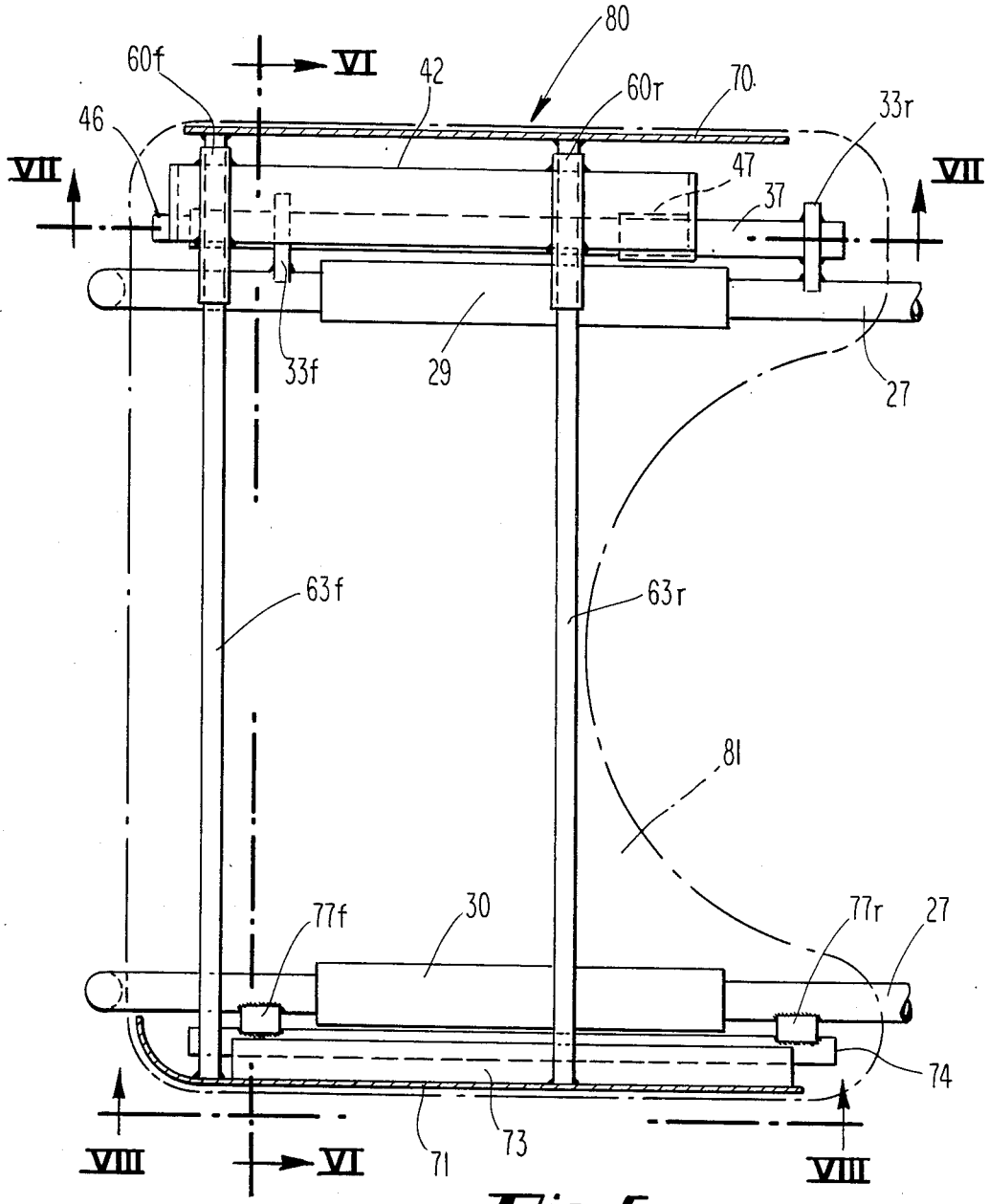
FIG. 5 is a plan view of the tray in the horizontal resting position taken along lines V—V of FIG. 4.

FIG. 5 shows a plan view of tray 80 (with tray surface 81 in phantom), as taken along lines V—V in FIG. 4. There are two spaced-apart, rectangularly shaped, front and rear anchor brackets **33*f*, 33*r* (with 33*f* shown partially in phantom) made of a solid material, each fixedly attached at one end to project outwardly in the horizontal plane from arm rest 27. Brackets 33*f*, 33*r* are joined at their outer ends to a guiding and bracing means in the form of a hollow side tube 37 of predetermined diameter and length, and of similar material as is used to make chair 20, that has its axis parallel to the axis of arm rest 27. Brackets 33*f*, 33*r* are separated by wheel chair arm rest pad 29 and, together with side tube 37, provide a sturdy base from which a slider tube 46 and a slidable, pivoting transposing means in the form of a tray holster 40 move about. Side tube 37 has an adjustable locking mechanism 42 (to be described below) attached adjacent an orifice near the front end thereof at the 180° radial (when viewing side tube 37 from the front) for stopping motion of slider tube 46, holster 40 and tray 80** at a desired location.

Tray holster 40 is slidably and rotatingly attached to geri chair arm 27 by means of a slider tube 46 and slider cuff 47 associated with side tube 37. Slider tube 46 is a sturdy, hollow tube of slightly smaller diameter than side tube 37 so as to allow frontwards and backwards sliding and rotating motion inside side tube 37. Attached to front end 46*f* of slider tube 46 to project laterally away from said tube is a front holster bracket 49*f*. Slider cuff 47 is a circular band of predetermined width and of a diameter slightly larger than side tube 37 that completely encircles tube 37 so as to slide over and rotate around tube 37 in between anchor brackets 33*f* and 33*r*. Attached to slider cuff 47 at the 240° degree radial (when viewing cuff 47 from the front) to project laterally away from side tube 37 is a rear holster bracket 49*r* similar to front holster bracket 49*f*. Front and rear holster brackets 49*f*, 49*r* are fixedly joined by tray holster 40, which is in a substantially parallel relationship to side tube 37 at all times.

Tray holster 40 is spaced laterally from side tube 37 a predetermined distance to allow convenient movement of tray 80 and its associated parts. Holster 40 is comprised of a holster band 42 and, in joining relation thereto, front and rear holster brackets 49*f*, 49*r* respectively. Front and rear holster brackets 49*f*, 49*r* are L-shaped brackets of predetermined dimensions as is known in the industry, and are oriented to face one another. Holster band 42 is joined to the outer surfaces of the respective right-angle portions of front and rear brackets 49*f*, 49*r*.

Holster band 42 is a flat piece of predetermined length and width to conform to the width of brackets 49*f*, 49*r*. Attached to the outer-facing side thereof in a transverse direction, and permanently joined thereto, are two hollow guide rod tubes 60*f*, 60*r* of predetermined length. Guide rod tubes 60*f*, 60*r* are spaced apart on band 42 a predetermined distance to provide stability of movement of tray 80, and are of similar construction. Tubes 60*f*, 60*r* are of similar material as side tube 37 and are made with a predetermined diameter. Tubes 60*f*, 60*r* have front and rear bushings 61*f*, 61*r*, respectively, joined at the front and rear edges, respectively, and serve to regulate and guide movement of two tray guide rods 63*f*, 63*r*, as is known in the art.

Tray guide rods 63*f*, 63*r* span the width of tray 80 and are permanently attached to right and left corner brackets 70, 71, respectively, (as viewed by the occupant) which are fixed to the underside of the tray. Tray 80 is a substantially rectangularshaped, flat piece constructed of known materials with a semicircular shape cut out of the side facing the geri chair occupant to facilitate different sizes of the upper body. It would be considered within the art to adapt different tray shapes to the present invention.

Figure 6:
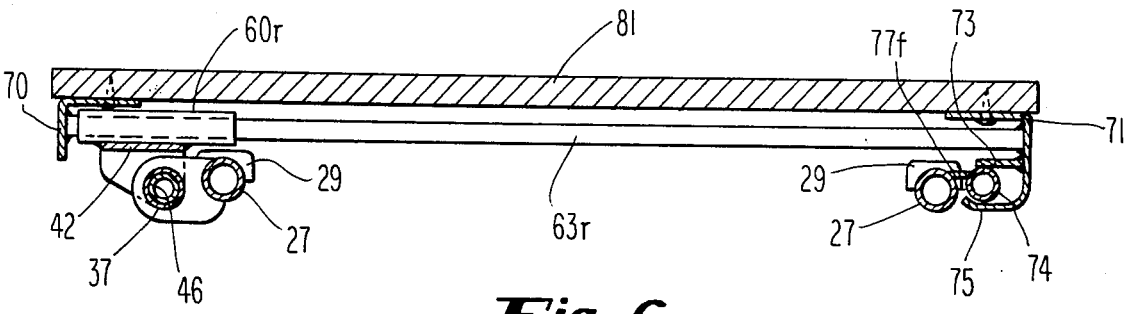
FIG. 6 is a view taken along lines VI—VI of FIG. 5.

FIG. 6 shows that tray 80 has a guide rail 73 fixed underneath the left-hand edge thereof (as viewed by the geri chair occupant) to matingly slide adjacent to a guide bar 74. Guide bar 74 is attached to left side geri chair arm rest 30 by two laterally depending brackets 77*f*, 77*r* similar to brackets 33*f*, 33*r* depending from right-side arm rest. In addition, guide rail 73 has a lower, shorter member 75, parallel to rail 73, to fit underneath bar 74 as in FIG. 6. Guide rail 73 is substantially as long as the side of tray 80 and is spaced apart and parallel to the underside of tray 80. Member 75 is an L-shaped extension from rail 73 spaced apart from rail 73 a distance larger than the width of bar 74. In this manner, rail 73 and member 75 act as the upper and lower portions of a sandwich to the guide bar 74 as tray 80 is moved forward and backward when in its horizontal position.

OPERATION OF GERIATRIC CHAIR TRAY

Figure 7:
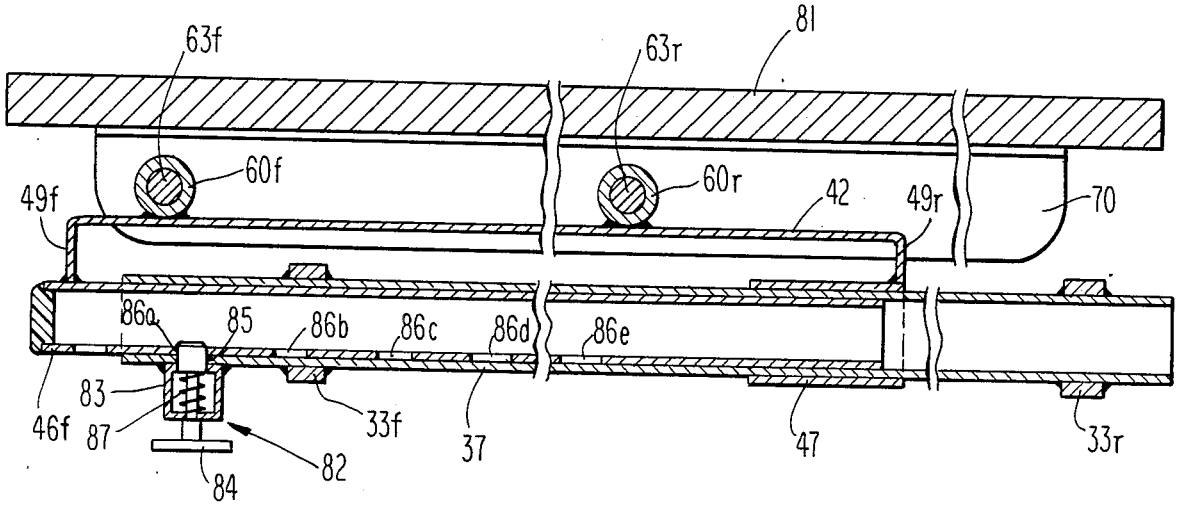
FIG. 7 is a view taken along lines VII—VII of FIG. 5.

In its storage mode, tray 80 hangs by means of slider tube 46 being inserted inside of side tube 37 and slider cuff 47 resting on, and encircling, the rear portion of side tube 37 (see FIG. 1). Slider tube 46 can be locked in place by an adjustable locking mechanism 82. As shown in FIG. 7, mechanism 82 is comprised of a tubular-shaped housing 83, fabricated from material similar to side tube 37, depending in a perpendicular manner from the underside of tube 37. Mechanism 82 is a spring-biased/plunger mechanism that has a plunger 84 forced through side tube opening 85 and into either one of a plurality of serially-placed slider tube openings 86*a* through *i* by compression spring 87 to lock slider tube 46 in place once tray 80 is in its horizontal, service position in front of the chair occupant, or into slider tube opening (not shown) to hold tray 80 in its storage position.

Referring to FIGS. 1, 2, 3 and 4, arrows A, B, C and D show the typical movement of tray 80 to go from a storage position alongside chair 20 (FIG. 1) to a service position in front of an occupant (FIG. 4, occupant not shown). Tray 80 can be raised vertically to the limit allowed by rods 63*f*, 63*r* as shown by arrow A in FIG. 1, and then plunger 84 pulled to allow slider tube 46 to move forward (carrying holster 40 and tray 80) as shown by arrow B (FIG. 2). FIG. 3 shows tray 80 in its forwardmost, vertical position and ready to be rotated to a horizontal position as depicted by arrow C. As seen in FIG. 3, once tray 80 rotates through 90° of arc, openings 86*a*, 86*b*, . . . 86*i* are also rotated 90° and aligned with mechanism 82.

Figure 8:
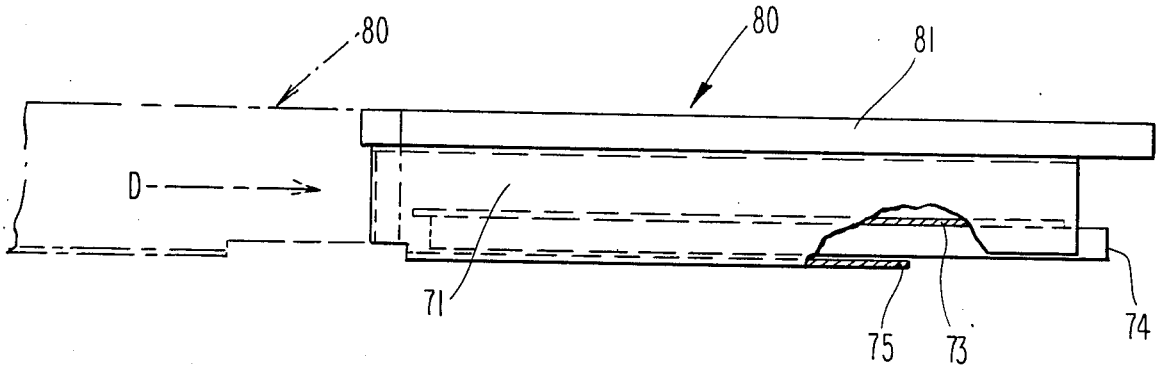
FIG. 8 is a view taken along lines VIII—VIII of FIG. 5.

FIGS. 4 and 8 show that tray 80 is now moved in a horizontal mode towards the occupant (arrow D). As seen in FIG. 8, bar 74 acts as a guide for tray 80 as it is moved towards chair 20. Rail 73 rests on, and slides over, bar 74 and when tray 80 reaches a predetermined point in the rearward direction, member 75 slips under bar 74 to prevent the side of tray 80 from being tilted upwardly. Plunger 84 is forced downward during the rearward movement of tray 80 until a convenient location is chosen, at which time it is released into opening 85 in slide tube 37 and the adjacent concentric opening in slider tube 46.

Many modifications and variations of the present invention are possible in light of the above teachings, and it is therefore understood that within the scope of the disclosed inventive concept, the invention may be practiced other than specifically described.

What is claimed is:

1. An improved adjustable tray table for use in combination with a frame member and designed for ease of movement from a storage position to a service position, comprising:

adjustment means in communication with said frame member for permitting slidable movement along and rotatable movement about said frame member, said adjustment means further including first tube means affixed with said frame member, second tube means engaging said first tube means for coaxial movement within said first tube means and cuff means coaxially associated with and for movement around said first tube means; and holster means operatively engaged with said second tube means and said cuff means, said holder means further providing a slidable engagement with said tray table;

whereby said adjustable tray table may be slidably moved relative to said holster means, may be slidably moved relative to said frame member and may be rotated together with said holster means about said frame member into said service position.

2. An improved adjustable tray table as in claim 1, for use with a geriatric chair wherein said frame member is integral with said geriatric chair.

3. An improved adjustable tray table as in claim 1, wherein said holster means further includes bracket means rotatably affixed to said slider cuff means and guide tube means affixed with said bracket means, said tray table further including rod means in slidable communication with said guide tube means.

4. An improved adjustable tray as in claim 3 for use with a geriatric chair, wherein said frame member constitutes a first side frame member and is one of a pair of opposed side frame members for said geriatric chair which includes a second side frame means, said tray further including tray table guide means in slidable communication with said second side frame means for partially supporting and guiding said tray table during inward and outward movement thereof.

5. An improved adjustable tray table as in claim 1, wherein said adjustment means includes adjustable locking means for stopping and locking said tray table with said frame member in one of a plurality of predetermined positions.

6. An improved adjustable tray table as in claim 5, wherein said adjustable locking means further includes: a tubular-shaped housing mounted adjacent an opening in the wall of the forward end of said first tube means; a plurality of openings serially located at predetermined points on said second tube means; a compression spring located coaxially inside said housing; and a plunger located coaxially inside said spring and forced by said spring for simultaneous engagement of adjacent openings in said first and second tube means.

7. An improved geriatric chair having a tray and a pair of oppositely disposed side frame members joined by a seat and a back comprising transposing means attached to the chair and said tray for making combined and simultaneous longitudinal, elevational and rotational movement of said tray in relation to the chair, wherein said transposing means further includes:

a. first tube means of predetermined diameter and length attached in a parallel manner to one of said oppositely disposed side frame members;

b. second tube means of smaller predetermined diameter and length than said first tube means and being coaxial therewith for movement in to and out of said first tube means;

c. cuff means of larger predetermined diameter than said first tube means and being coaxial therewith for movement around said first tube means; and d. tray holster means attached to said cuff means and the forward end of said second tube means, said holster means having guide means attached thereto for controllable moving of said tray in a desired movement.

8. An improved geriatric chair having a tray and a pair of oppositely disposed side frame members joined by a seat and a back comprising:

a. bracket means fixedly attached at predetermined position to one of said opppositely disposed side frame members;

b. first tube means of predetermined diameter attached to said bracket means;

c. second tube means of smaller predetermined diameter and length than said first tube means and being coaxial therewith for movement into and out of said tube means;

d. cuff means of larger predetermined diameter than said first tube means and being coaxial therewith for movement around said first tube means;

e. tray holster means attached to said cuff means and the forward end of said second tube means;

f. guide means attached to said holster means and having rod means coaxial therewith for sliding movement therewith, said rod means being attached at opposite ends to the opposite edges of the underside of said tray; and g. adjustable locking means attached to said tray for stopping and locking said tray in one of a plurality of predetermined positions.

* * * * *